US007858277B2

(12) United States Patent
Takeda

(10) Patent No.: US 7,858,277 B2
(45) Date of Patent: Dec. 28, 2010

(54) PHOTOSENSITIVE BODY, DEVELOPING UNIT, AND IMAGE FORMING APPARATUS

(75) Inventor: Makoto Takeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 802 days.

(21) Appl. No.: 11/468,449

(22) Filed: Aug. 30, 2006

(65) Prior Publication Data

US 2007/0065738 A1 Mar. 22, 2007

(30) Foreign Application Priority Data

Sep. 16, 2005 (JP) ..... 2005-270025

(51) Int. Cl.
*G03G 5/00* (2006.01)

(52) U.S. Cl. ..... 430/58.05; 430/61; 399/123

(58) Field of Classification Search ..... 430/58.05, 430/61; 399/123
See application file for complete search history.

(56) References Cited

U.S. PATENT DOCUMENTS

2002/0126196 A1* 9/2002 Yamauchi ..... 347/129
2004/0023139 A1* 2/2004 Yoshimura et al. ..... 430/59.6
2004/0048179 A1* 3/2004 Tanaka et al. ..... 430/58.7
2004/0063014 A1* 4/2004 Yoshimura et al. ..... 430/59.6
2004/0142259 A1* 7/2004 Uesugi et al. ..... 430/58.2
2004/0146315 A1* 7/2004 Ueda et al. ..... 399/159
2007/0217820 A1* 9/2007 Shigemori et al. ..... 399/134

FOREIGN PATENT DOCUMENTS

JP 59-044054 A 3/1984

* cited by examiner

*Primary Examiner*—Hoa V Le
(74) *Attorney, Agent, or Firm*—Panitch Schwarze Belisario & Nadel LLP

(57) ABSTRACT

A photosensitive body according to this invention includes a photosensitive layer formed on a surface thereof for being electrically charged and having an electrostatic latent image formed thereon by being exposed to light irradiation, and wherein the photosensitive layer has an initial dynamic friction coefficient μk0 of 0.6 or less against a prescribed member, and wherein where a dynamic friction coefficient of the photosensitive layer against the prescribed member after a prescribed friction is given is defined as a dynamic friction coefficient μk1, the photosensitive layer has a dynamic friction coefficient variation amount Δμk, as a difference between the initial dynamic friction coefficient μk0 and the dynamic friction coefficient μk1, of 0.06 or less. The photosensitive layer having the above mentioned structure has superior durability due to superior wear resistance, so that the photosensitive layer can be made thinner while preventing duration deterioration that may occur with the thinner photosensitive layer.

13 Claims, 6 Drawing Sheets

PRINTING PATTERN FOR PRINTING DURABILITY TEST

PHOTOSENSITIVE BODY, DEVELOPING UNIT, AND IMAGE FORMING APPARATUS

BACKGROUND OF THE INVENTION

This invention relates to a photosensitive body, a developing unit having the photosensitive body, and an image forming apparatus having the photosensitive body and the developing unit.

Electrophotographic technology is recently widely used and applied not only in a field of copying machines but also in a field of various printers, since conventionally high quality images can be instantly obtained. Regarding a photosensitive body, which is a core element of the electrophotographic technology, as a photoconductive material thereof, the photosensitive body using an organic photoconductive material, having advantages such as, e.g., non-polluting and easy to deposit and to fabricate, prevails nowadays. Among an organic photosensitive body, a functionally separated type photosensitive body, in which a charge generation layer and a charge transport layer are layered, is widely prevalent. The functionally separated type photosensitive body has become mainstream of the photosensitive body, because a sensitive photosensitive body can be obtained by combining not only an efficient charge generation substance but also an efficient charge transport substance, because a highly safe photosensitive body can be obtained due to an availability of a wide range of materials, and because the functionally separated type photosensitive body is relatively advantageous in cost due to high coating efficiency. Regarding an electrostatic latent image formation mechanism of the functionally separated type photosensitive body, first, the light irradiates a charged photosensitive body to pass through the charge transport layer, and is absorbed by a charge generation substance in the charge generation layer, thus generating charges. Subsequently, the generated charges are injected into the charge transport layer at an interface between the charge generation layer and the charge transport layer, and is further moved by an electric field in the charge transport layer toward an outermost surface, then forming an electrostatic latent image by neutralizing surface charges on the photosensitive body. Recently, demand for a higher quality image formed in an electrophotographic process is further increasing. To realize this demand, it is necessary to prevent dispersion of electrostatic latent images in a photosensitive layer, and to improve reproducibility of thin lines and minute dots. Such a photosensitive body is specifically described in Japanese Unexamined Patent Publication No. Sho 59-044054.

However, the organic photosensitive body is easily worn by repeated use, and develops a strong tendency for further progression of charge potential drop, luminous sensitivity deterioration, and density drop of the photosensitive body, or image degradation such as, e.g., background fogginess due to deteriorating progression of photosensitive layer wear. In other words, there raises a problem that photosensitive body's durability cannot be maintained where the photosensitive layer is made thinner. Recently, higher durability of the photosensitive body is increasingly demanded because of a smaller diameter of the photosensitive body due to speed up or a smaller size of the image forming apparatus.

This invention is made in consideration of the above described problem, and it is an object of this invention to provide a photosensitive body having a thinner photosensitive layer while preventing duration deterioration that may occur with the thinner photosensitive layer, a developing unit having the photosensitive body, and an image forming apparatus having the photosensitive body and the developing unit.

BRIEF SUMMARY OF THE INVENTION

To solve the above described problem, a photosensitive body according to this invention includes a photosensitive layer formed on a surface thereof for being electrically charged and having an electrostatic latent image formed thereon by being exposed to light irradiation, wherein the photosensitive layer has an initial dynamic friction coefficient $\mu k0$ of 0.6 or less against a prescribed member, and wherein where a dynamic friction coefficient of the photosensitive layer against the prescribed member after a prescribed friction is given is defined as a dynamic friction coefficient $\mu k1$, the photosensitive layer has a dynamic friction coefficient variation amount $\Delta\mu k$, as a difference between the initial dynamic friction coefficient $\mu k0$ and the dynamic friction coefficient $\mu k1$, of 0.06 or less.

The photosensitive layer of the photosensitive body having the above mentioned structure can be made thinner while preventing duration deterioration that may occur with the thinner photosensitive layer.

BRIEF DESCRIPTION OF THE SEVERAL VIEWS OF THE DRAWINGS

This invention may take physical form in certain parts and arrangements of parts, a preferred embodiment and method of which will be described in detail in this specification and illustrated in the accompanying figures which form a part hereof, and wherein.

In the drawings.

DETAILED DESCRIPTION OF THE INVENTION

Hereinafter, an embodiment according to this invention will be described in detail with reference to the figures.

An image forming apparatus according to the first embodiment of this invention transfers developer images onto paper using a developing unit having a photosensitive body (hereinafter referred to as "the photosensitive drum") serving as an electrostatic latent image carrier, and a transfer unit, and subsequently fuses the transferred developer images onto the paper using a fusing unit, subsequently discharging the paper to a prescribed stacker. The photosensitive drum arranged in an interior of the developing unit has a structure as described below, and is made to prevent durability deterioration that may occur with the thinner photosensitive layer.

First, a structure and printing operation of the image forming apparatus 1 according to the first embodiment of this invention will be described in detail.

Figure 1:
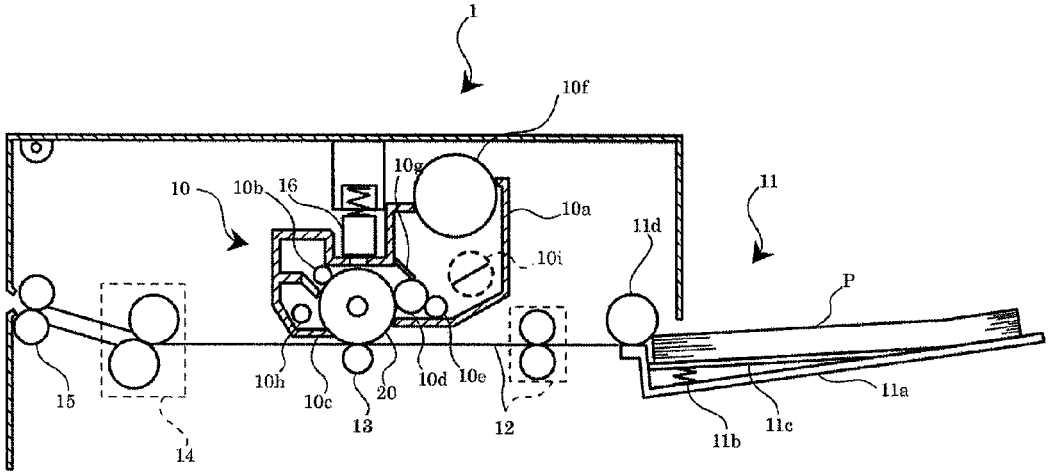
FIG. 1 is a schematic cross-sectional view showing a structure of an image forming apparatus according to the first embodiment of this invention for illustrating the structure and operation of the image forming apparatus.

The image forming apparatus 1 is composed of, as shown in FIG. 1, a developing unit 10 for developing the developer images based on image information, a feed mechanism 11 for feeding paper P to the developing unit 10, a conveyance unit 12 for conveying the paper P fed from the feed mechanism 11 along a prescribed paper conveyance route, a transfer unit 13 for transferring the developer images onto the paper P, a fusing unit 14 for fusing on the paper P the developer images transferred onto the paper P at the transfer unit 13, a discharging mechanism 15 for discharging the paper P on which the developer images are fused at the fusing unit 14 to an outside of the image forming apparatus 1, and an exposure unit 16 for exposing a latent image based on the image information on a surface of a photosensitive drum 20 of the developing unit 10, as described below.

The paper feed mechanism 11 is composed of a feed stacker 11*a* for stacking the paper P, a feed stage 11*c* formed on or above the feed stacker 11*a* for moving the paper P upward by urging force of a spring 11*b*, and a feed roller 11*d* for feeding the paper P one by one to an interior of the image forming apparatus 1.

With such the feed mechanism 11, when an information processing unit transmits the image information to the image forming apparatus 1 after a user has stacked the paper P on the feed stacker 11*a*, the feed stage 11*c* is moved upward by a printing control unit, not shown. The feed stage 11*c* is moved upward so that the paper P contacts the feed roller 11*d*. Then, the paper P is fed into an interior of the image forming apparatus 1 by rotation of the feed roller 11*d*. The conveyance unit 12 conveys the paper P fed into an interior of the image forming apparatus 1 to the developing unit 10 along a prescribed conveyance route.

The developing unit 10 formed detachably from the image forming apparatus 1 is a member to develop latent images based on the image information transmitted from a host unit such as, e.g., an information processing unit. The developing unit 10 is unitedly formed by a cartridge case 10*a* having a vacant interior. The followings are formed in the interior of the cartridge case 10*a*: the photosensitive drum 20 on the surface of which latent images based on the image information are exposed; a charging roller 10*b* for giving a prescribed a bias voltage to the photosensitive drum 20; a cleaning blade 10*c* made with an elastic member for removing the developer remaining on the surface of the photosensitive drum 20; a developing roller 10*d* for developing the developer images on the latent images on the surface of the photosensitive drum 20; a feed roller 10*e* for feeding the developer to the developing roller 10*d*; a developer cartridge 10*f* for storing the developer to be provided to the cartridge case 10*a*; a developing blade 10*g* for uniformalizing the developer attached to a surface of the developing roller 10*d*; a conveyance unit 10*h* for conveying the developer removed by the developing blade 10*g* to the developer cartridge 10*f*; and a stirring member 10*i* for stirring the developer in the interior of the cartridge case 10*a*.

With such the developing unit 10, when the information processing unit transmits the image information, the image information is converted to a signal in a predetermined form by the printing control unit, not shown, to be provided to the exposure unit 16. The exposure unit 16 is composed as a plurality of arrayed light emitting elements such as, e.g., LED (Light Emitting Diode), and exposes one line of a latent image by causing the light emitting elements to emit light based on a signal provided by the printing control unit, not shown. Those operations are done in a manner synchronized with rotation of the photosensitive drum 20. At this moment, the bias voltage is applied to the surface of the photosensitive drum 20 by the charging roller 10*b*, and a bias voltage of a portion exposed by the exposure unit 16 is neutralized, the detail of which will be described below. Subsequently, the exposed portion contacts the developing roller 10*d*, and the developer attaches to the exposed portion. Thus, the developer images are developed on the surface of the photosensitive drum 20 based on the image information. Subsequently, together with the transfer unit 13 whose surface is charged by a voltage power source, not shown, the developing unit 10 transfers onto the paper P the developer images developed on the surface of the photosensitive drum 20 by conveying the paper P in a manner to nip the paper P. The paper P on the surface of which the developer images are transferred is further conveyed by the conveyance unit 12 to the fusing unit 14.

The fusing unit 14 is a member to fuse the developer images attached to the paper P onto the paper P using heat. The fusing unit 14 is composed of a fusing roller 14*a* having a heat source, not shown, in an interior thereof, and a conveyance roller 14*b* for conveying, working together with the fusing roller 14*a*, the paper P in a manner to nip the paper P. When the paper P is conveyed to the fusing unit 14, the paper P is conveyed in a manner nipped between the fusing roller 14*a* and the conveyance roller 14*b* previously heated by the heat source, not shown, and subsequently the developer on the paper P is melted and fused by heat of the fusing roller 14*a* and by pressure given by the fusing roller 14*a* and the conveyance roller 14*b*. Subsequently, the paper P whose surface has the fused developer is conveyed to the discharging mechanism 15, and the discharging mechanism 15 discharges the paper P to an outside of the image forming apparatus 1 to provide the paper P to the user.

Subsequently, a structure of the photosensitive drum 20 will be hereinafter described in detail.

Figure 2A:
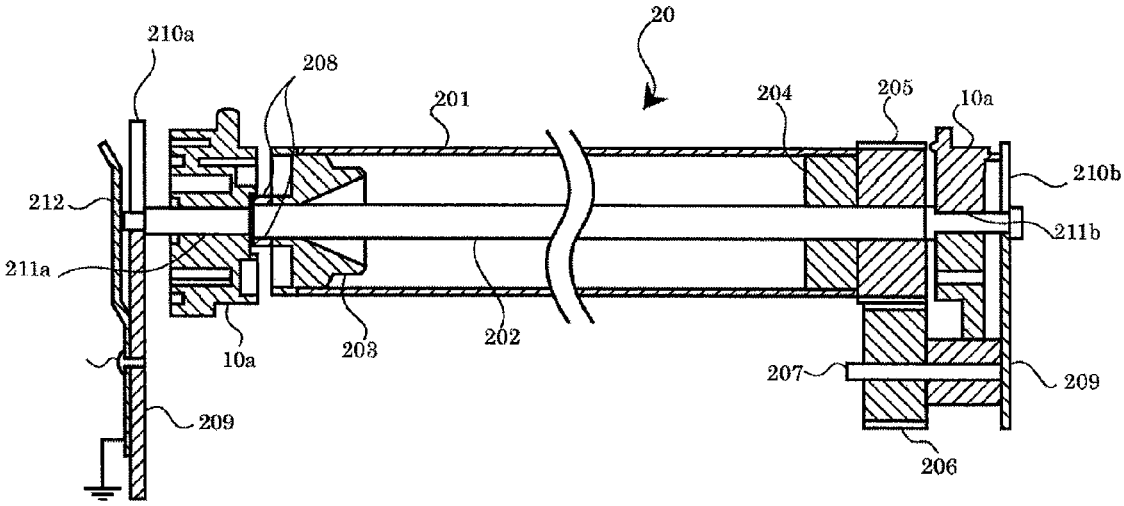
FIG. 2A is a cross-sectional view showing an essential portion of a developing unit of the image forming apparatus for illustrating a structure of a photosensitive drum arranged in an interior of the developing unit.

The photosensitive drum 20 is formed detachably from the developing unit 10, and is a member rotating about a shaft 202 as an axis, both ends of which are rotatably supported by the cartridge case 10*a*, as shown in FIG. 2*a*. Specifically, the photosensitive drum 20 is composed of a drum body 201 formed in a cylindrical shape with a material described below, a metal shaft 202 made with a conductive material, a flange 203 for closing one end of the drum body 201, a supporting member 204 for closing the other end of the drum body 201, a gear 205 for driving the shaft 202, a driving gear 206 for transmitting driving force to the gear 205, an axis 207 for transmitting driving force from a driving source, not shown, to the driving gear 206, and a collar 208 arranged between the flange 203 and the cartridge case 10*a*. Furthermore, when the developing unit 10 is mounted on an interior of the image forming apparatus 1, the photosensitive drum 20 is mounted on a flame 209 for attaching the developing unit 10. Long holes 210*a* and 210*b* are formed on the flame 209, and both ends of the shaft 202 are accommodated in the long holes 210*a* and 210*b* when the developing unit 10 is mounted on the flame 209.

The shaft 202 is a member to be a rotation axis of the photosensitive drum 20, and is formed together with the photosensitive drum 20 detachably from the developing unit 10. Furthermore, the shaft 202 is inserted into a hole formed in the center of the gear 205, and is secured thereto. Furthermore, the shaft 202 has one near end portion inserted into a bearing bore 211*b* formed on the cartridge case 10*a*, and is further accommodated in an interior of the long hole 210*b*. On the other hand, the other near end portion of the shaft 202 is inserted into a bearing bore 211*b* formed on the cartridge case 10*a*, and is further accommodated in an interior of the long hole 210*a* Furthermore, the other end of the shaft 202 contacts a spring member 212 secured to the cartridge case 10*a*.

The flange 203 is a member pressed into one near end portion of the drum body 201, and is secured to an inside of the drum body 201 using a nonconductive adhesive. The shaft 202 is inserted into a near-center portion of the flange 203 and is attached rotatably with respect to the shaft 202. As a material for such the flange 203, a synthetic resin such as, e.g., polyamide, polycarbonate, ABS (Acrylonitrile Butadiene Styrene) resin, and polyacetal is used. The flange 203 is made electrically conductive by blending the above mentioned material with conductive powder such as, e.g., metal powder, carbon black, and graphite.

The supporting member 204 is a member pressed into the other near end portion of the drum body 201. The supporting member 204 is attached rotatably with respect to the shaft 202, and secured to an inside of the drum body 201 in a way similar to the flange 203. The gear 205 is secured to a surface exposed to outside of the drum body 201. The supporting member 204 is a member to rotate the entire photosensitive drum 20 by rotating in a manner synchronized with the gear 205. Specifically, the gear 205 rotates about the shaft 202 as an axis, and thereby the supporting member 204 rotates in a manner synchronized with the gear 205. Rotation of the supporting unit 204 causes the drum body 201 to rotate.

Figure 2B:
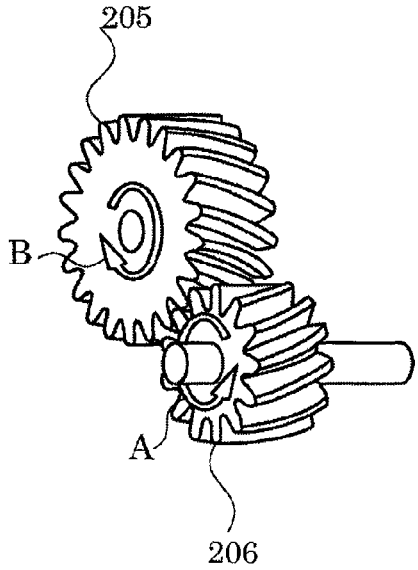
FIG. 2B is a perspective view showing gears secured to an end of the photosensitive drum for illustrating a method of rotating the photosensitive drum.

The gear 205 and the driving gear 206 are formed with so-called helical gears, as shown in FIG. 2*b*, and respective helix teeth angles thereof are arranged opposite to one another. Regarding the gear 205 and the driving gear 206 as described above, the driving gear 206 rotates about the axis 207 as an axis in a direction indicated by Arrow A, and thereby the gear 205 rotates about the shaft 202 as an axis in a direction indicated by Arrow B. The gear 205 rotates in a direction indicated by Arrow B, and thereby the other end of the shaft 202 is urged in a direction to press the spring member 212. The shaft 202 presses the spring member 212, and thus provides good contact between the other end of the shaft 202 and the spring member 212.

The collar 208 is arranged between the flange 203 and the cartridge case 10*a*, and is a member having conductivity. The collar 208 is formed in a approximate cylindrical shape. The shaft 202 is inserted into an interior of the collar 208, and the collar 208 is attached rotatably about the shaft 202 and slidably in a axial direction of the shaft 202.

The flame 208 is a member for supporting the shaft 202, and the spring member 212 is secured to an outside of the flame 209 by a pin 213. The spring member 212 is connected to a ground, and has urging force inwardly. Where the cartridge case 10*a* is not installed, although the spring member 212 is located at slightly inner side than that shown in FIG. 2*a*, the cartridge case 10*a* can be installed from above by outwardly inclining an upper end of the spring member 212. The spring member 212 is pressed against the shaft 202 in an installed state.

Figure 3:
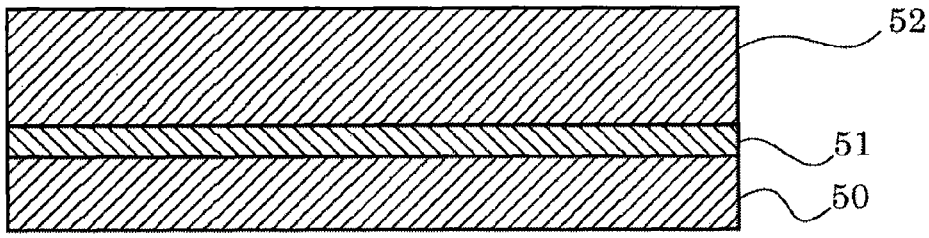
FIG. 3 is a cross-sectional view showing a structure of a drum body of the photosensitive drum for illustrating a structure of the drum body.

The drum body 201 is a member on a surface of which the latent images are exposed by the exposure unit 16. The drum body 201 is composed of, as shown in FIG. 3, a conductive supporting body 50 serving as a base for other members, an undercoating layer 51 for preventing halation, and a photosensitive layer 52 which the exposure unit 16 exposes to form the latent images.

As the conductive supporting body 50, for example, a metallic material such as, e.g., aluminum, stainless steel, copper, or nickel, or an insulative supporting body such as, e.g., polyester film or paper, having a conductive layer such as, e.g., aluminum, copper, palladium, tin oxide, or indium oxide, can be used.

The undercoating layer 51 for preventing halation is formed between the conductive supporting body 50 and the photosensitive layer 52. For example, an inorganic layer such as, e.g., aluminum anodic oxidation film, aluminum oxide, or aluminum hydroxide, or an organic layer such as, e.g., polyvinyl alcohol, casein, polyvinyl pyrrolidon, polyacrylic acid, a type of cellulose, gelatin, starch, polyurethane, polyimide, or polyamide, can be used as the undercoating layer 51. It is to be noted that the undercoating layer 51 is to be arranged as needed, and therefore the drum body 201 can also be formed in a manner that the photosensitive layer 52 is arranged directly on top of the conductive supporting body 50.

There are three types of the photosensitive layer 52 as below: a layered type photosensitive body in which a charge generation layer formed mainly with a charge generation substance and a charge transport layer formed mainly with a charge transport substance and a binder resin are successively layered on top of the conductive supporting body 50; an inverted two-layered type photosensitive body in which a charge transport layer formed mainly with a charge transport material and a binder resin and a charge generation layer formed mainly with a charge generation substance are successively layered on top of the conductive supporting body 50; and a dispersion type photosensitive body in which a charge generation substance is dispersed into a layer having a charge transport substance and a binder resin on top of the conductive supporting body 50. Either of the above three types is applicable to the photosensitive layer 52.

Furthermore, where the photosensitive layer 52 is the layered type photosensitive body or the inverted two-layered type photosensitive body, various types of an organic pigment or a dye can be used as the charge generation substance used in the charge generation layer. Among them, it is preferred to use non-metallic phthalocyanine, phthalocyanine to which metals, their oxides, or chlorides, such as, e.g., copper, indium chloride, gallium chloride, tin, oxytitanium, zinc, or vanadium, are coordinated, or azo pigments such as, e.g., monoazo, bisazo, trisazo, or polyazo pigments. The charge generation layer may be the dispersion layer containing particles of those substances in a form bound by various types of a binder resin such as, e.g., polyester resin, polyvinyl acetate, polyacrylic acid ester, polymethacrylic acid ester, polyester, polycarbonate, polyvinyl acetacetal, polyvinyl propional, polyvinyl butyral, phenoxy resin, epoxy resin, urethane resin, cellulose ester, or cellulose ether can be used. Regarding a usage ratio in this case, the charge generation substance is used in an amount of 30 to 500 parts by weight per 100 parts by weight of the binder resin, and the film thickness thereof is preferably 0.1 to 2 μm. The charge generation layer may include, as necessary, various types of an additive agent such as, e.g., a leveling agent for improving coating properties, an antioxidant, or a sensitizer. The charge generation layer may be evaporated film of the above mentioned charge generation substances.

As the charge transport substance used for the charge transport layer, it is preferred to use a heterocyclic compound such as, e.g., carbazole, indole, imidazole, oxazole, pyrazole, oxadiazole, pyrazoline, or thiadiazole, or an electron donative substance such as, e.g., an aniline derivative, a hydrazone compound, an aromatic amine derivative, a stilbene derivative, or a polymer having a group formed with those compounds in the main chain or in the side chain of the polymer.

Furthermore, as the binder resin used for the charge transport layer, it is preferred to use polycarbonate, polymethyl methacrylate, polystyrene, a vinyl polymer such as polyvinyl chloride or the like, polyester, polyester carbonate, polysulfone, polyimide, phenoxy, epoxy, silicone resin, or a copolymer of those substances. Partly cross-linking hardener or the like can be used as a single substance or in admixture, and it is especially preferred to use polycarbonate.

The charge transport layer may include, as necessary, various types of an additive agent such as, e.g., an antioxidant or a sensitizer. Furthermore, the film thickness of the charge transport layer is preferably 5 to 30 μm. Where the photosensitive layer 52 is the dispersion type photosensitive layer, the above-mentioned charge generation substances are dispersed into a charge transport medium consisting of the above-mentioned combination of the binder resin and the charge transport substance at the above-mentioned compounding ratio. The particle size of the charge generation substance in this case needs to be sufficiently small, and it is preferred to use 1 μm or smaller particle size. Sufficient sensitivity cannot be obtained where the photosensitive layer has the charge generation substance dispersed thereinto in too small amount, whereas a bad effect occurs such as, e.g., charging characteristics deterioration or sensitivity deterioration where in too large amount. Therefore, it is preferred to use the charge generation substance in an amount of 0.5 to 50% by weight. It is preferred that the film thickness of the photosensitive layer 52 be 5 to 30 μm. In this case, it is also desired to blend a publicly known plasticizer for improving, e.g., film-forming properties, flexibility, and mechanical strength, an additive agent for suppressing a residual potential, a dispersing aid for improving dispersion stability, or a leveling agent, a surfactant, a silicone oil, a fluorochemical oil, or others for improving coating properties.

As a method for forming each layer, a publicly known method can be applied such as, e.g., successively applying coating liquids obtained by dissolving or dispersing in a solvent a substance or substances to be contained in each layer.

Hereinafter, a method and a result of a performance test of the photosensitive drum 20 conducted by the inventors et al. will be described in detail. Specifically, an effect of an initial dynamic friction coefficient μk0 and a variation amount Δμk of the dynamic friction coefficient on image quality is evaluated using a generally used photosensitive drum as a sample. Furthermore, since a reduced film thickness of the photosensitive layer of the photosensitive drum depends also on circumferential length of the photosensitive drum, the effect of the circumferential length of the photosensitive drum on the initial dynamic friction coefficient μk0 and the variation amount Δμk of the dynamic friction coefficient is evaluated.

First, the evaluation of the effect of the initial dynamic friction coefficient μk0 and the variation amount Δμk of the dynamic friction coefficient on image quality is described in detail.

Regarding a structure of the drum body 201 of the photosensitive drum 20 used in this test, the above-mentioned sample is a layered type photosensitive body. A bisazo compound is used as the charge generation substance in the charge generation layer, and the dispersion layer in a form bound by polyvinyl butyral as the binder resin is formed. A quantity of the charge generation substance is 50% by weight with respect to the binder resin, and the film thickness thereof is 0.5 μm. A hydrazone compound is used as the charge transport substance in the charge transport layer, and polycarbonate is used as the binder resin. The molecular weight of the binder resin of samples A to D is approximately 30000, E to H is approximately 33000, and I to K is approximately 27000, as shown in TABLE 1. As shown in TABLE 1, a quantity of the charge transport substance of each sample is 40 to 50% by weight with respect to the binder resin. Furthermore, the charge transport layer of each sample has the film thickness of 18 μm respectively.

TABLE 1

| Sample | Molecular weight of the binder resin in the charge transport layer | % by weight of the charge transport substance in the charge transport layer | μk0 | Δμk | Reduced film amount of the photosensitive layer (μm/10k sheets) | Image quality |
|---|---|---|---|---|---|---|
| A | Approximately | 40 | 0.510 | 0.024 | 0.78 | Good |
| B | 30000 | 44 | 0.579 | 0.052 | 1.22 | Good |
| C | | 46 | 0.595 | 0.058 | 1.32 | Good |
| D | | 48 | 0.605 | 0.062 | 1.38 | Poor |
| E | Approximately | 42 | 0.538 | 0.055 | 1.27 | Good |
| F | 33000 | 44 | 0.556 | 0.060 | 1.35 | Average |
| G | | 45 | 0.575 | 0.069 | 1.49 | Poor |
| H | | 46 | 0.590 | 0.072 | 1.54 | Poor |
| I | Approximately | 48 | 0.594 | 0.047 | 1.14 | Good |
| J | 27000 | 49 | 0.600 | 0.050 | 1.33 | Average |
| K | | 50 | 0.618 | 0.059 | 1.36 | Poor |

First, in order to demonstrate a relationship between a friction coefficient and wear resistance of the drum body 201, the friction coefficient and the wear resistance are measured in a manner described below.

Figure 4:
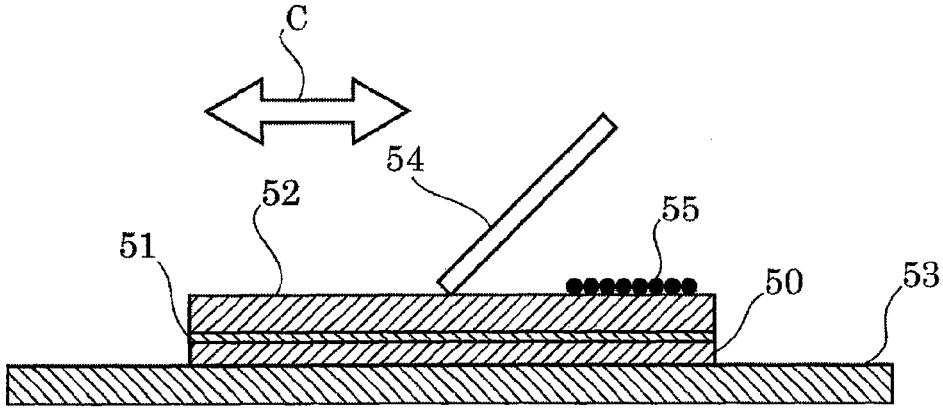
FIG. 4 is a cross-sectional view showing a sample used for a friction coefficient and wear resistance test of the drum body.

A full automatic friction and wear meter DFPM-SS type made by Kyowa Interface Science Co, LTD. was used to measure the dynamic friction coefficient μk. As shown in FIG. 4, a sample 230 is formed by successively layering the conductive supporting body 50, the undercoating layer 51, and the photosensitive layer 52 on top of a stage 53 in a manner similar to the drum body 201. Urethane rubber for blade 54, made with the same kind of substance as the cleaning blade 10*c* and cut into 1 cm width, is used against a side to be abraded of the sample 230, and is secured at a position contacting the sample at an angle of 45 degrees. The measurement was performed in a state that a developer 55 is thinly placed (0.4 to 1.0 mg/cm$^2$) on the photosensitive body 52 in a manner that a surface of the photosensitive body 52 can be seen. Furthermore, the urethane rubber for blade 54, carrying a load of 200 g, was made to move reciprocally in a direction indicated by Arrow C with a stroke of 20 mm and with a moving speed of 0.1 mm/sec. The temperature was 23 degrees Celsius, and the humidity was 50% RH at that time.

Under the conditions set forth hereinabove, after measuring the initial dynamic friction coefficient μk0, the measurement was repeated twenty times or more in the same way, and the dynamic friction coefficient μk1 was measured in a state that the film on the surface of the photosensitive layer 52 was worn. The dynamic friction coefficient μk started to vary when film wear of the photosensitive body 52 began, and a value to which the variation was converged was defined as the dynamic friction coefficient μk1. The difference between the initial dynamic coefficient μk0 and the dynamic coefficient μk1 is defined as the dynamic friction coefficient variation amount Δμk.

Figure 11:
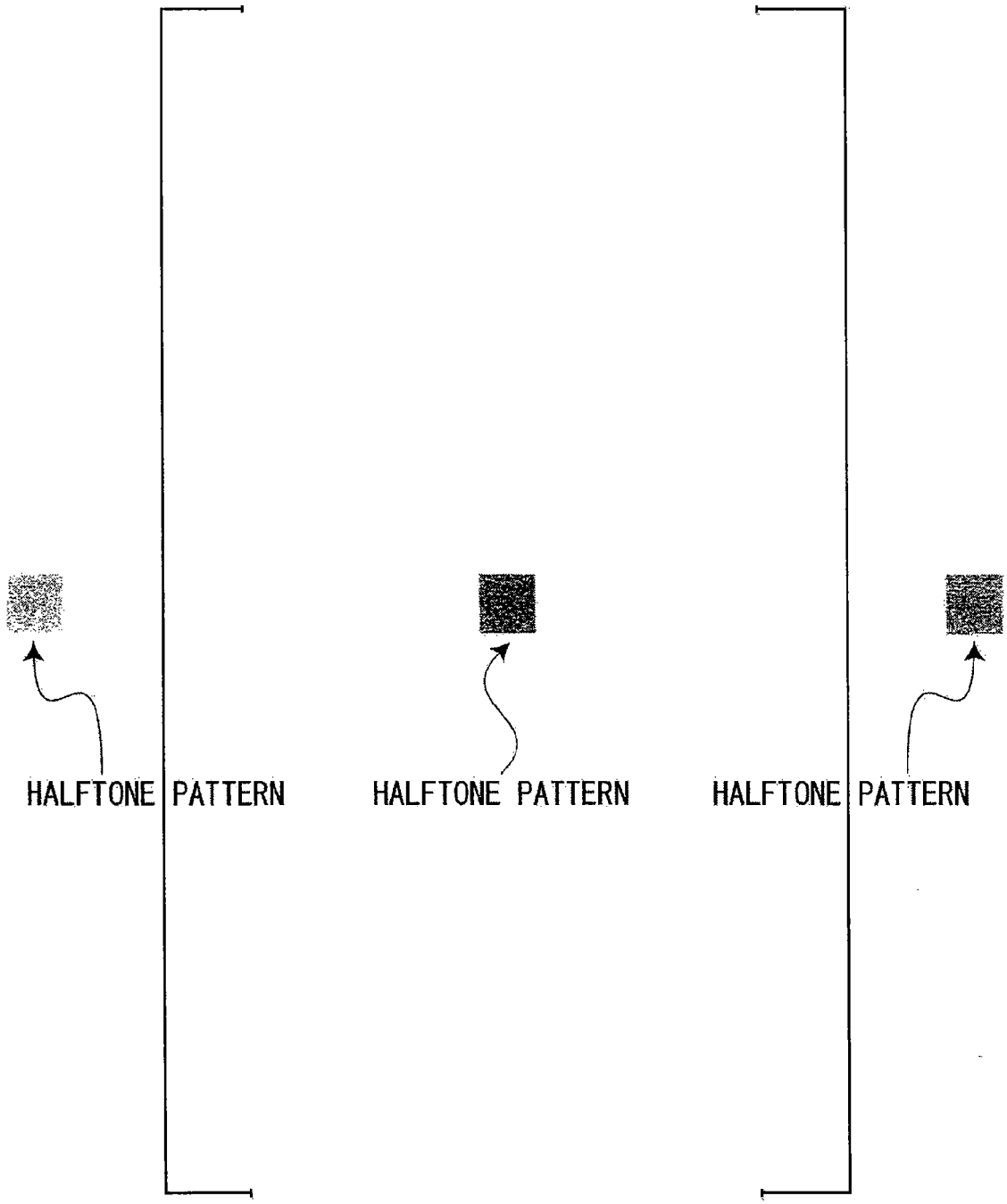
FIG. 11 is a graph showing a printing pattern for a printing durability test described herein.

Subsequently, a printing durability test of 40000 printing sheets was carried out using a prescribed test printer in order to measure a wear amount of the photosensitive body. An outer diameter of the photosensitive drum of the test printer was 30 mm, and a circumferential speed thereof was 10 cm/second. The printing durability test used A4 size high quality paper of type P (64 g/m2) made by Fuji Xerox for print run, and letter size paper (24 lb, 90 g/m2) made by Hammermill for image quality evaluation where Optical Density values are measured to evaluate smears in a background image on paper. The printing durability test used a carbon black pulverized toner whose particle size is 5 to 10 μm, and the printing ratio of the printing pattern, as shown in FIG. 11, was 0.3%. The printing durability test was carried out under the test environment at the temperature of 23 degrees centigrade and the humidity of 50% RH. Wear of the photosensitive body was measured using an eddy-current film thickness monitor. It is to be noted that film thickness was measured at the center of the photosensitive body.

First, the initial dynamic friction coefficient μk0, the variation amount Δμk thereof, and image quality evaluation results are shown in TABLE 1. Upon performing printing on paper, smears in a background image on paper become conspicuous, thus deteriorating image quality thereof due to reduced film of the photosensitive body. Using a Macbeth densitometer, O.D. (Optical Density) value of the paper before printing and a maximum background O.D. value thereof after printing were measured, so that the smears were evaluated with a difference between the two O.D. values. An image quality result was evaluated as "Good" where the difference between the O.D. values was less than 0.02 so that smears could not be visually recognized, "Average" where the difference between the O.D. values was 0.02 or more and was less than 0.03 so that it was vague whether smears could be visually recognized, "Poor" where the difference between the O.D. values was 0.03 or more so that smears could be visually recognized easily. Although "Good" and "Average" are acceptable quality, only "Good" is preferred.

Figure 5:
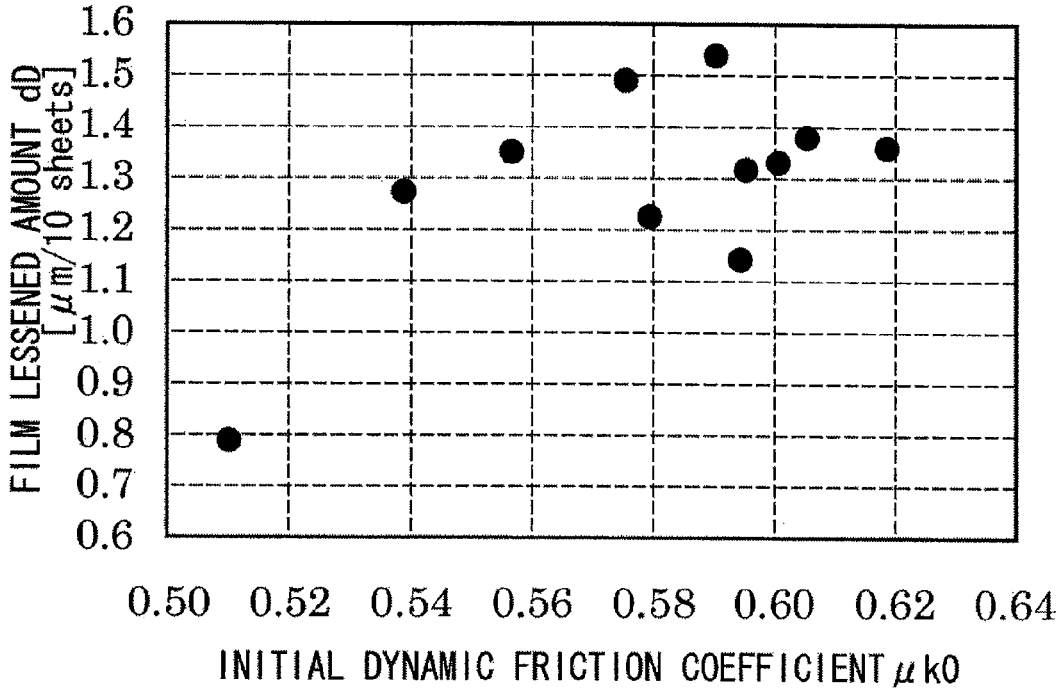
FIG. 5 is a graph showing a relationship between an initial dynamic friction coefficient $\mu k0$ and a reduced film amount dD per 10000 sheets of printing, obtained in the above mentioned test.

FIG. 5 shows a relationship, obtained by carrying out the printing durability test using the test printer according to the above mentioned condition, between the initial dynamic friction coefficient μk0 and the reduced film amount dD per 10000 printing sheets. According to the test result shown in FIG. 5, although correlation can be recognized between the initial dynamic friction coefficient μk0 and the reduced film amount dD, it turns out that the reduced film amount dD of the photosensitive body does not necessarily become smaller as the initial dynamic friction coefficient μk0 becomes smaller. According to FIG. 5 and TABLE 1, although smears on paper surely occur in accordance with an increase of the reduced film amount dD where the initial dynamic friction coefficient μk0 is 0.6 or more, it turns out that smears on paper occur even where the initial dynamic friction coefficient μk0 is 0.6 or less. Items evaluated as "Good" or "Average" are cases where the reduced film amount dD is 1.35 μm/10 k sheets or less. Therefore, it turns out that an occurrence of smears on paper depends on a remaining amount of the photosensitive body.

Although it is generally considered that a correlation exists between wear of the photosensitive drum and the initial dynamic friction coefficient μk0, the correlation is not necessarily applicable to some cases as shown by the result of this test. Since the dynamic friction coefficient μk varies between an initial state where the photosensitive body film is not reduced at all and a state where the photosensitive body film is reduced, the variation amount Δμk of the dynamic friction coefficient must be considered where the reduced film amount dD is defined with the initial dynamic friction coefficient μk0.

Figure 6:
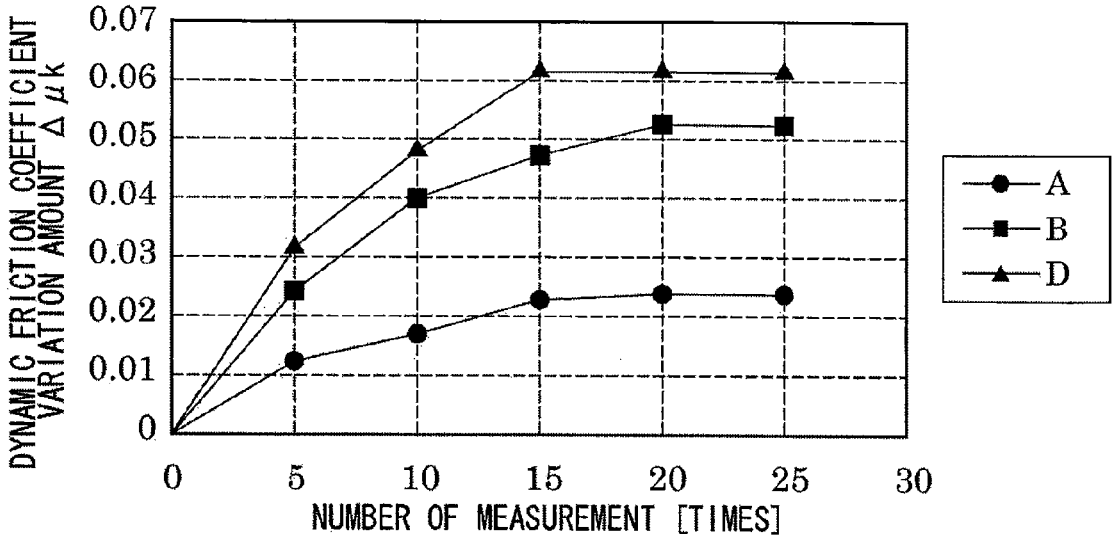
FIG. 6 is a graph showing a relationship between the number of measurement and a dynamic friction coefficient variation amount $\Delta\mu k$ obtained in the above mentioned test.

FIG. 6 shows a relationship between a number of the measurement and the variation amount Δμk of the dynamic friction coefficient where the measurement of the dynamic friction coefficient μk was repeated twenty times or more. The data shown in FIG. 6 show the variation amount Δμk of the dynamic friction coefficient of samples A, B, and D in TABLE 1. FIG. 6 shows that the variation amount Δμk varies depending on the photosensitive drum. Microscopic asperities exist on the surface of the photosensitive layer where the surface is not at all worn. However, upon being worn a little, the surface of the photosensitive body is smoothed so that slip characteristics thereof become better. Therefore, the dynamic friction coefficient μk becomes smaller than in an initial state, and the variation converges and becomes approximately constant when the surface becomes smooth. A large variation amount Δμk results from the easily smoothed surface at an initial wear, namely, a large worn amount or a large reduced film amount.

Figure 7:
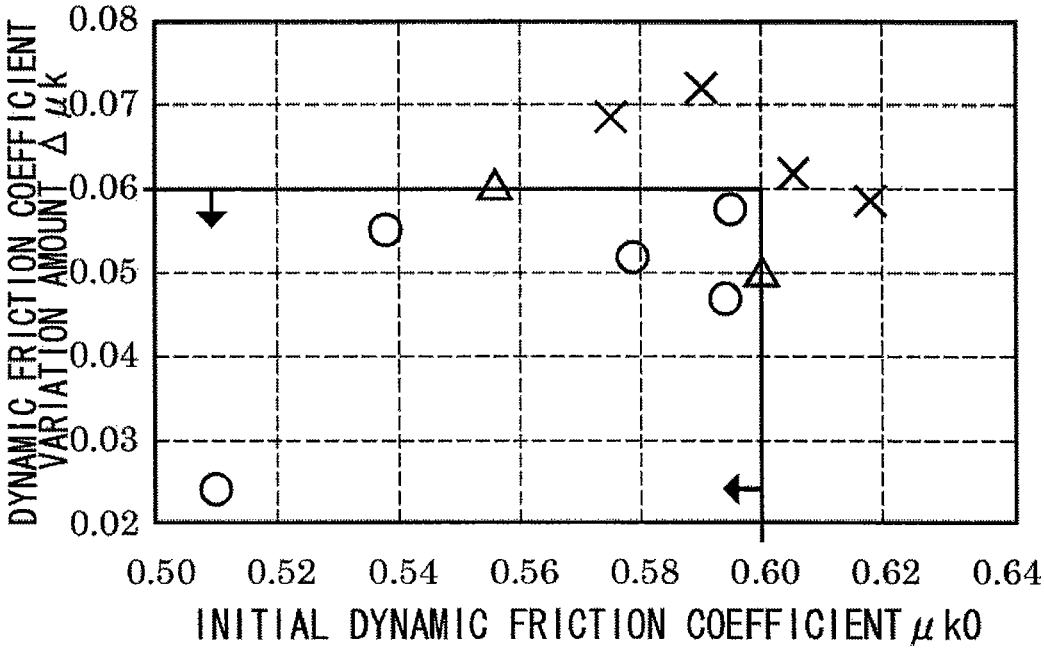
FIG. 7 is a graph showing a relationship between the initial dynamic friction coefficient $\mu k0$, the dynamic friction coefficient variation amount $\Delta\mu k$, and an evaluation result of image quality obtained in the above mentioned test.
Figure 8:
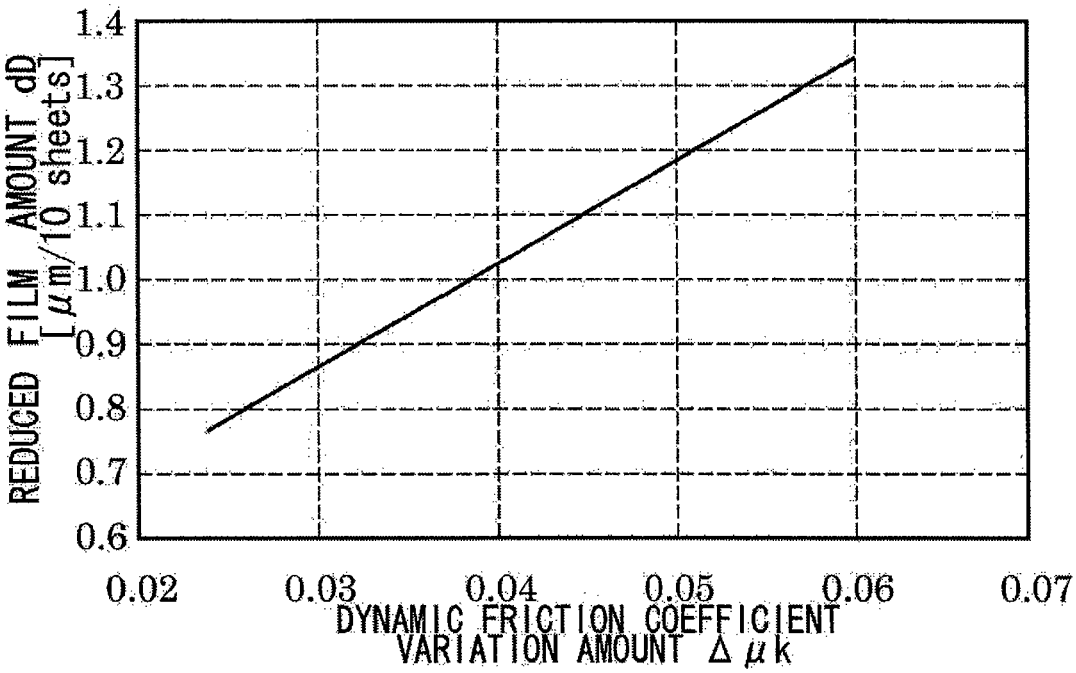
FIG. 8 is a graph showing a relationship between the dynamic friction coefficient variation amount $\Delta\mu k$ and the reduced film amount dD obtained in the above mentioned test.

Shown in FIG. 7 is a relationship among the initial dynamic friction coefficient μk0, the variation amount thereof Δμk, and the result of image quality evaluation in TABLE 1. As shown in FIG. 7, in order to form a photosensitive drum with high printing durability, it turns out that the conditions that the initial dynamic friction coefficient μk0 of the surface of the photosensitive layer is 0.6 or less, and that the variation amount Δμk of the dynamic friction coefficient thereof is 0.06 or less must be fulfilled. FIG. 8 shows a relationship between the variation amount Δμk of the dynamic friction coefficient, and the reduced film amount dD. As shown in FIG. 8, it turns out that the more the variation amount Δμk of the dynamic friction coefficient is, the more the reduced film amount dD is.

Therefore, since image quality is degraded where the reduced film amount dD is 1.35 mm/10 k sheets or more, it turns out that the image quality is degraded where the variation amount Δμk of the dynamic friction coefficient is 0.06 mm or more.

As shown by the results of this test, where the surface of the photosensitive body is the charge transport layer, a percentage by weight of the charge transport substance is desired to be smaller with respect to the binder resin of the charge transport layer, and absolute weight of the charge transport substance is also desired to be smaller, so that the initial dynamic friction coefficient μk0 and the variation amount thereof Δμk fulfill the above mentioned conditions. Therefore, the binder resin with molecular weight thereof adjusted is to be used as described above.

It is to be noted that a material to be used as the photosensitive layer must not necessarily be the one used in this test, and that the initial dynamic friction coefficient and the variation amount thereof need only to be in the above mentioned range.

Figure 9:
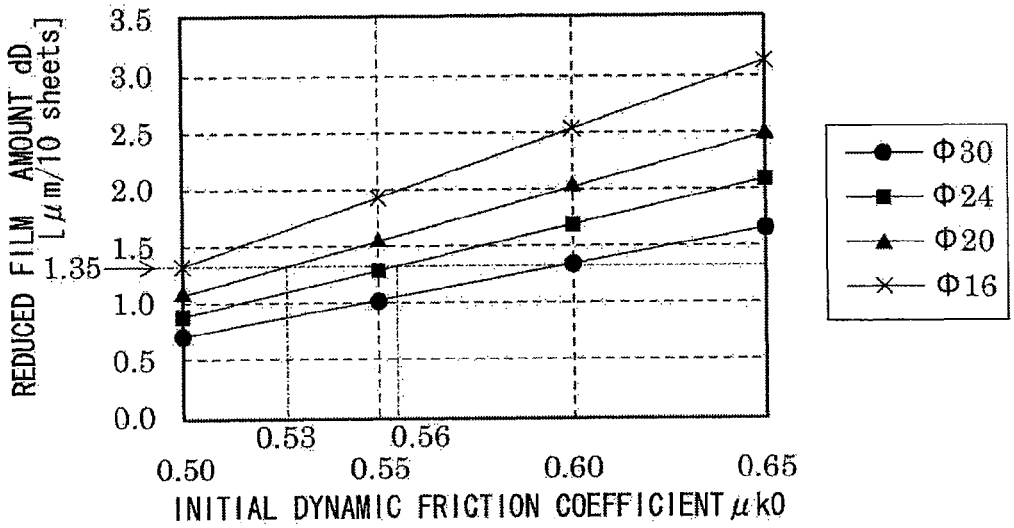
FIG. 9 is a graph showing a relationship between the initial dynamic friction coefficient $\mu k0$ and the reduced film amount dD obtained in the test in which the photosensitive drum is changed.

Subsequently, evaluation of effect of a circumferential length of the photosensitive drum on the initial dynamic friction coefficient μk0 and the variation amount Δμk of the dynamic friction coefficient will be hereinafter described in detail.

Where the outer diameter of the photosensitive drum is either 16 mm, 20 mm, or 24 mm for example, the reduced film amount dD is respectively 1.875 times, 1.5 times, or 1.25 times more than that of the photosensitive drum having the outer diameter of 30 mm. Regarding photosensitive drums with the above mentioned outer diameters, a relationship between the initial dynamic friction coefficient μk0 and the reduced film amount dD is shown in FIG. 9. According to the above described test result concerning the effect of the initial dynamic friction coefficient μk0 and the variation amount thereof Δμk on image quality, the reduced film amount dD should be 1.35 or less, which corresponds to the initial dynamic friction coefficient μk0 of 0.6 or less, in order to obtain good image quality where the outer diameter of the photosensitive drum is 30 mm. Therefore, it turns out that the derived dynamic friction coefficient ranges of respective outer diameters in order to obtain a good quality image is that: the initial dynamic friction coefficient μk0<0.50 where the outer diameter of the photosensitive drum is 16 mm; the initial dynamic friction coefficient μk0<0.53 where the outer diameter of the photosensitive drum is 20 mm; and the initial dynamic friction coefficient μk0<0.56 where the outer diameter of the photosensitive drum is 24 mm.

Figure 10:
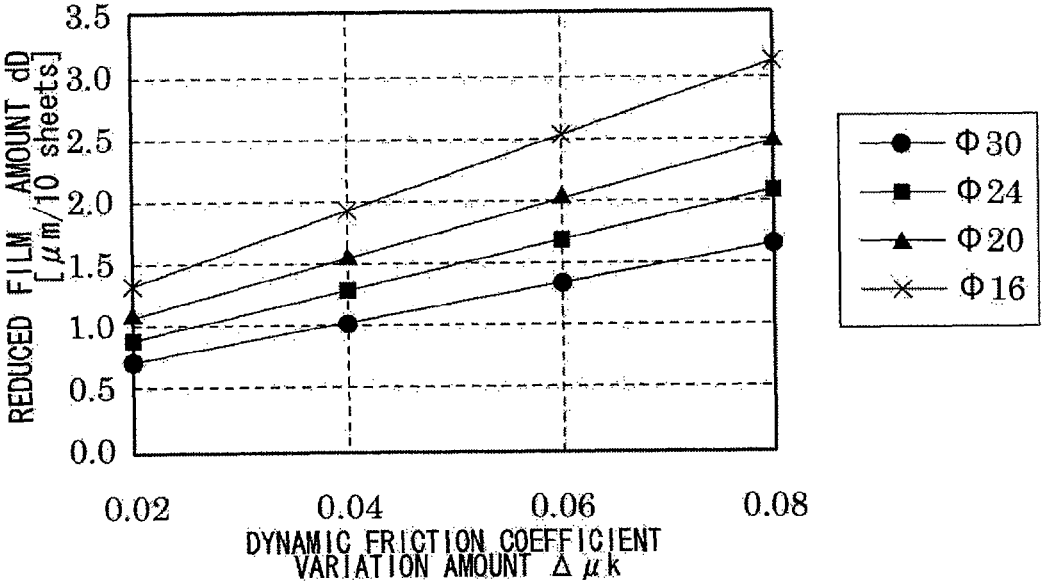
FIG. 10 is a graph showing a relationship between the dynamic friction coefficient variation amount Δμk and the reduced film amount dD.

Furthermore, generalizing the result shown in FIG. 9, where the outer diameter of the photosensitive drum is defined as L mm, a derived relationship between the outer diameter L of the photosensitive drum and a maximum μk0max of the initial dynamic friction coefficient is expressed as: μk0max=0.0071×L+0.387. A relationship between the variation amount Δμk of the dynamic friction coefficient and the reduced film amount dD is shown in FIG. 10. A maximum thereof Δμkmax is expressed as: Δμkmax=0.0028×L−0.025. Therefore, the conditions that μk0 is less than or equal to 0.0071×L+0.387, and that Δμk is less than or equal to 0.0028×L−0.025 must be fulfilled in order to obtain good image quality.

From the above relationship, where the outer diameter of the photosensitive drum is either 16 mm, 20 mm, or 24 mm, the initial dynamic friction coefficient μk0 and the variation amount Δμk of the dynamic friction coefficient must fulfill the following conditions: that the initial dynamic friction coefficient μk0<0.50 and the dynamic friction coefficient variation amount Δμk<0.020 where the outer diameter of the photosensitive drum is 16 mm; that the initial dynamic friction coefficient μk0<0.53 and the dynamic friction coefficient variation amount Δμk<0.031 where the outer diameter of the photosensitive drum is 20 mm; and that the initial dynamic friction coefficient μk0<0.56 and the dynamic friction coefficient variation amount Δμk<0.042 where the outer diameter of the photosensitive drum is 24 mm.

Where the surface of the photosensitive layer 51 is the charge transport layer, a percentage by weight of the charge transport substance with respect to the binder resin is rendered smaller than the value shown in the above mentioned test result, or molecule weight of the binder resin is rendered smaller than the value shown in the above mentioned test result, so that the initial dynamic friction coefficient μk0 and the variation amount Δμk of the dynamic friction coefficient can be in the above mentioned range.

Therefore, with the image forming apparatus 1 having such the photosensitive drum, the reduced film amount dD of the photosensitive layer 51 can be decreased by specifying a value of the initial dynamic friction coefficient μk0 and the dynamic friction coefficient variation amount Δμk of the material used in the photosensitive layer 51 where the photosensitive layer 51 of the electrophotographic photosensitive body is formed. Therefore, not only durability of the electrophotographic photosensitive body is improved, but also reduced is effect of the photosensitive layer 51 on a printed image based on a scar formed by the cleaning blade 10*c* or the developer. Furthermore, since the reduced film amount dD of the photosensitive layer becomes less, an initial film thickness thereof can be made thinner, and thus a high quality image can be obtained from the image forming apparatus.

As described above, even where an outer diameter of the photosensitive drum is either 16 mm, 20 mm, or 24 mm, substantially the same operation and image quality as the photosensitive drum having an outer diameter of 30 mm is assured. Where an outer diameter of the photosensitive drum is made either 16 mm, 20 mm, or 24 mm, the image forming apparatus 1 can be made more compact while maintaining high image quality.

This invention is not limited to the above mentioned embodiments. For example, this invention is applicable even where the outer diameter of the photosensitive drum is 30 mm or more. This invention is applicable even where the photosensitive body is not a drum type but a belt type as long as corresponding circumferential length is the same or more. Although the printer is taken as an example of the image forming apparatus having the photosensitive drum in the above embodiments, this invention can also be applied to any image forming apparatus having a photosensitive body such as, e.g., a photocopier or a facsimile.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

I claim:

1. A combination of a photosensitive body in contact with a prescribed elastic member, comprising:

a photosensitive layer formed on a surface of the photosensitive body for being electrically charged and having an electrostatic latent image formed thereon by being exposed to light irradiation;

wherein the prescribed elastic member is in contact with the photosensitive layer, and wherein said photosensitive layer has an initial dynamic friction coefficient μk0 of 0.51 to 0.6 or less against the prescribed member, and wherein where a dynamic friction coefficient of said photosensitive layer against said prescribed member after a prescribed friction is given is defined as a dynamic friction coefficient μk1, and said photosensitive layer has a dynamic friction coefficient variation amount Δμk, as a difference between said initial dynamic friction coefficient μk0 and said dynamic friction coefficient μk1, of 0.024 to 0.06.

2. The combination according to claim 1, wherein said prescribed friction is a friction to render said dynamic friction coefficient variation amount Δμk approximately constant.

3. The combination according to claim 1, wherein said prescribed elastic member is a prescribed elastic blade.

4. The combination according to claim 2, wherein said prescribed elastic member is a prescribed elastic blade.

5. The combination according to claim 3, wherein said initial dynamic friction coefficient μk0 is a dynamic friction coefficient where said prescribed elastic blade contacting said photosensitive layer with 200 g force is reciprocally moved with a stroke of 20 mm, and wherein said dynamic friction coefficient μk1 is a dynamic friction coefficient after said prescribed elastic blade contacting said photosensitive layer with 200 g force is reciprocally moved with a stroke of 20 mm for 20 times.

6. The combination according to claim 1, wherein said photosensitive body is a photosensitive drum having said photosensitive layer formed on a peripheral surface thereof and having an outer diameter of 30 mm or more.

7. The combination according to claim 2, wherein said photosensitive body is a photosensitive drum having said photosensitive layer formed on a peripheral surface thereof and having an outer diameter of 30 mm or more.

8. The combination according to claim 1, wherein said photosensitive body is a photosensitive drum having said photosensitive layer formed on a peripheral surface thereof and having an outer diameter of L mm, and wherein said photosensitive layer is made with a material complying with said initial dynamic friction coefficient μk0 fulfilling the following formula 1 and complying with said dynamic friction coefficient variation amount Δμk fulfilling the following formula 2:

$$\mu k0 \text{ is equal to or less than } 0.0071 \times L + 0.387 \qquad \text{Formula 1}$$

$$\Delta\mu k \text{ is equal to or less than } 0.0028 \times L - 0.025 \qquad \text{Formula 2.}$$

9. The combination according to claim 2, wherein said photosensitive body is a photosensitive drum having said photosensitive layer formed on a peripheral surface thereof and having an outer diameter of L mm, and wherein said photosensitive layer is made with a material complying with said initial dynamic friction coefficient μk0 fulfilling the following formula 1 and complying with said dynamic friction coefficient variation amount Δμk fulfilling the following formula 2:

$$\mu k0 \text{ is equal to or less than } 0.0071 \times L + 0.387 \qquad \text{Formula 1}$$

$$\Delta\mu k \text{ is equal to or less than } 0.0028 \times L - 0.025 \qquad \text{Formula 2.}$$

10. A developing unit comprising:

an image carrier including said combination according to claim 1;

a developing section that develops an electrostatic latent image on said image carrier by using a developer.

11. An image forming apparatus for forming an image on a prescribed recording medium, the image forming apparatus comprising:

said developing unit according to claim 10; and a transfer unit for transferring a developer image developed by said developing unit on said recording medium.

12. The combination according to claim 1, wherein the photosensitive layer comprises a charge transport layer, and the charge transport layer comprises a charge transport substance and a binder resin, wherein a quantity of the charge transport substance in the charge transport layer is 40 to 50% by weight with respect to the binder resin.

13. The combination according to claim 12, wherein a film thickness of the charge transport layer is 5 to 30 μm.

* * * * *